United States Patent [19]

Olson et al.

[11] 4,059,221

[45] Nov. 22, 1977

[54] SHIPPING CONTAINER AND BLANK THEREFOR

[75] Inventors: Gregory J. Olson; Wayne A. Chapman, both of Burlington, Wis.

[73] Assignee: Packaging Corporation of America, Evanston, Ill.

[21] Appl. No.: 711,493

[22] Filed: Aug. 4, 1976

[51] Int. Cl.[2] ..... B65D 5/10
[52] U.S. Cl. ..... 229/39 R
[58] Field of Search ..... 229/37 R, 38, 39, 37 T

[56] References Cited

U.S. PATENT DOCUMENTS

| | | | |
|---|---|---|---|
| 1,134,998 | 4/1915 | Davidson | 229/39 R |
| 1,852,527 | 4/1932 | King | 229/39 R X |
| 1,956,619 | 5/1934 | McAleer | 229/39 R X |
| 2,209,593 | 7/1940 | Bernis | 229/39 R X |
| 2,329,628 | 9/1943 | Lanigan | 229/37 R |
| 2,783,933 | 3/1957 | Sharts | 229/37 R |
| 3,365,109 | 1/1968 | Kessler et al. | 229/39 R X |
| 3,417,911 | 12/1968 | Hennessey | 229/37 R |

FOREIGN PATENT DOCUMENTS

| | | | |
|---|---|---|---|
| 98,558 | 11/1924 | Austria | 229/38 |

*Primary Examiner*—Davis T. Moorhead
*Attorney, Agent, or Firm*—Neuman, Williams, Anderson & Olson

[57] ABSTRACT

A shipping container is provided which is formed from a blank of foldable sheet material. The container includes a top closure flap which is foldably connected to the upper edge of one of four side panels. The closure flap has a shape which corresponds substantially to the area delimited by the upper edges of the side panels. Foldably connected to a peripheral segment of the closure flap is a finger pull tab which is disposed a substantial distance from the connection of the flap to the side panel. The finger pull tab facilitates initially moving the closure flap from a closed position to an open position. A first pair of alternate bottom closure flaps is foldably connected to corresponding side panels. Each of the first pair of bottom closure flaps is provided with a locking tab which is interlockingly accommodated within an elongated slot formed in a bottom closure flap which is one of a second pair of alternate bottom closure flaps.

9 Claims, 11 Drawing Figures

FIG. 1
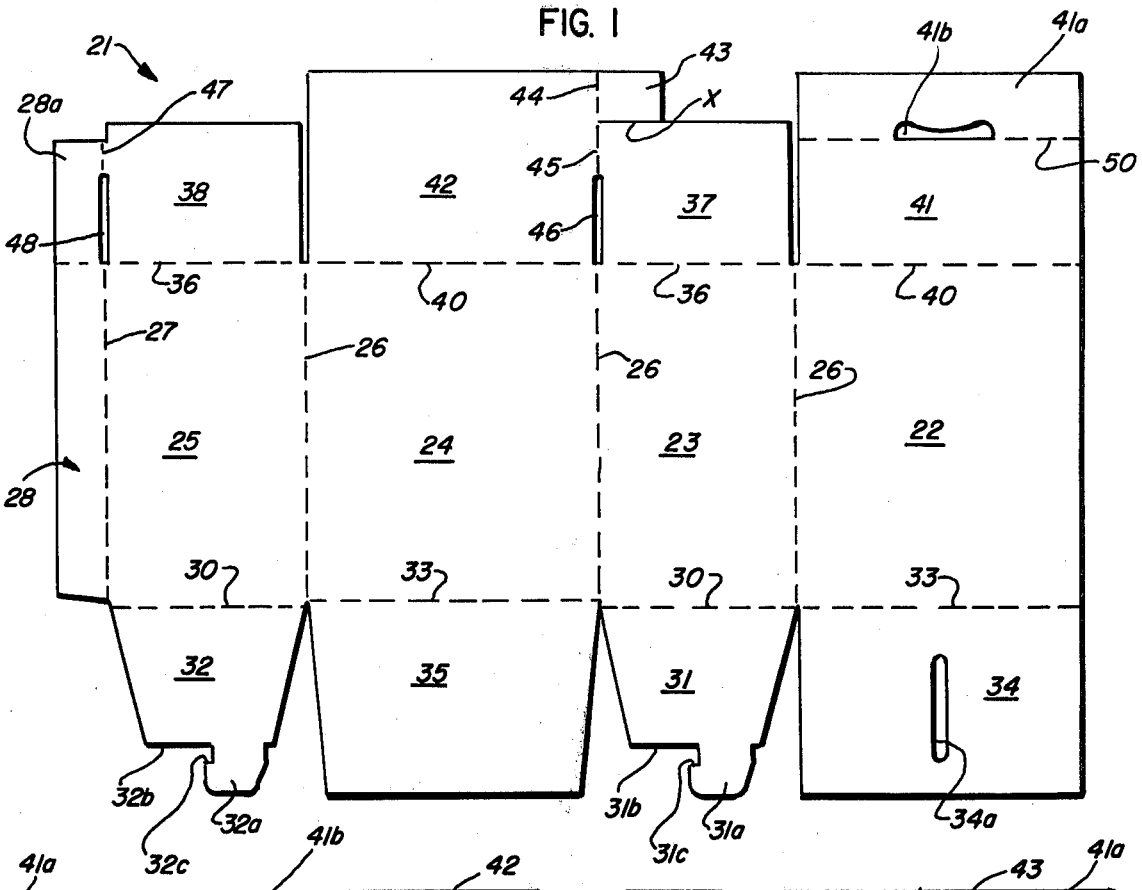
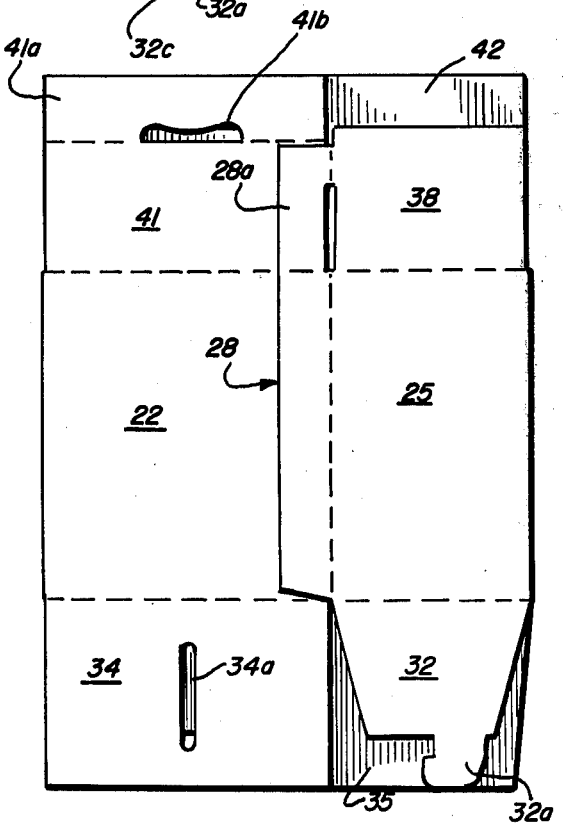
FIG. 2
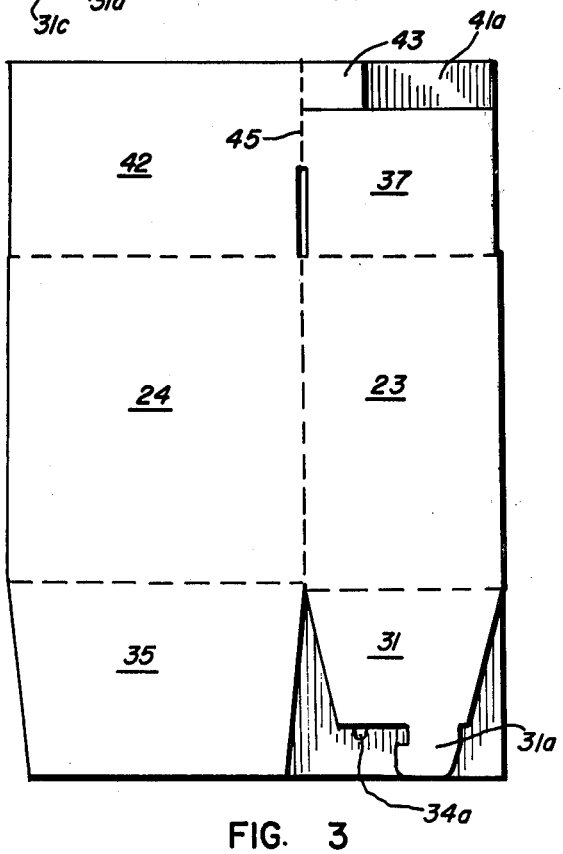
FIG. 3

SHIPPING CONTAINER AND BLANK THEREFOR

BACKGROUND OF THE INVENTION

Heretofore in the bulk packing of ice cream of the like it has been customary to utilize cylindrical containers. Such containers were performed by the manufacturer and either stored and/or shipped in such a condition thereby requiring an inordinate amount of space. Normally such cylindrical containers required separate top and bottom closures thereby significantly increasing the cost and complexity of manufacture of the container. Furthermore, removal of the top closure by the customer, once the contents of the container had solidified, oftentimes became a difficult, awkward and time-consuming operation and caused mutilation of the container.

SUMMARY OF THE INVENTION

Thus, it is an object of the invention to provide a shipping container which is of simple, sturdy and inexpensive construction and is capable of accommodating a variety of products.

It is a further object of the invention to provide a shipping container which is formed from a single blank of foldable sheet material.

It is a further object of the invention to provide a shipping container which, prior to loading, may be readily stored or shipped in a collapsed condition.

It is a still further object of the invention to provide a blank for a shipping container which may be readily formed utilizing conventional high-speed cutting, slotting and scoring equipment.

It is a still further object of the invention to provide a shipping container which may be readily set up manually or by automatic equipment.

It is a still further object of the invention to provide a shipping container which, when loaded, may be stored or packed with like containers in a compact space.

Further and additional objects will appear from the description, accompanying drawings and appended claims.

In accordance with one embodiment of the invention, a shipping container is provided which includes four foldably connected side panels having alternate side panels arranged in spaced opposed relation. A first pair of bottom closure flaps is provided which are foldably connected to the bottom edges of alternate side panels. Each flap is provided with a locking tab which projects from the edge of the flap opposite the connection of the flap to the side panel. A second pair of bottom closure flaps is provided which are foldably connected to the bottom edges of the remaining alternate side panels. The second pair of flaps are disposed in overlapping relation. The first pair of flaps overlie the overlapping second pair of flaps and the locking tabs of the first pair of flaps are interlockingly accommodated in an elongated slot formed in the outermost of the overlapping second pair of flaps.

A top closure flap is foldably connected to the upper edge of one of the side panels. The top closure flap has a shape which is substantially the same as the area delimited by the upper edges of the side panels. Foldably connected to a peripheral segment of the top closure flap which is spaced a substantial distance from the folding axis of the flap is a finger pull tab. The pull tab facilitates manual moving of the top closure flap from an initial closed position to an open position.

DESCRIPTION

For a more complete understanding of the invention reference should be made to the drawings wherein:

FIG. 1 is a top plan view of a blank for one form of the improved shipping container.

FIGS. 2 and 3 are front and back views, respectively, of the blank of FIG. 1 after the initial step of setting up the blank has been performed.

Figure 11:
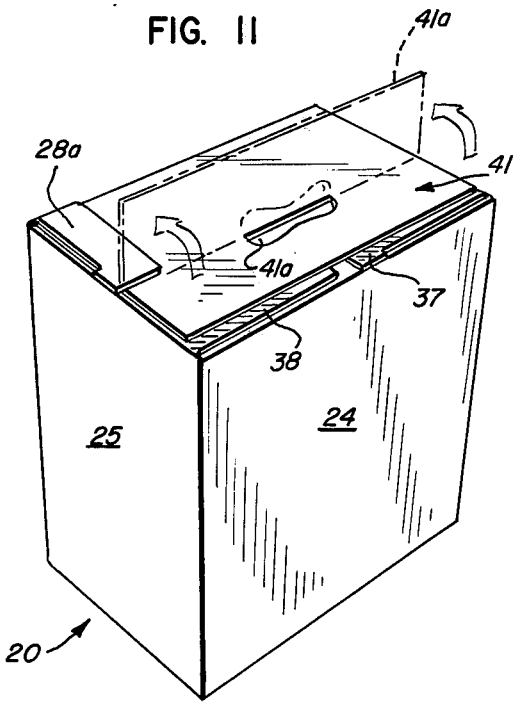
FIG. 11 is similar to FIG. 10 but showing the loaded improved shipping container ready for storage or shipping; the handle portion thereof being shown in phantom lines in an operative position.

Referring now to the drawings and more particularly to FIG. 11, one form of an improved shipping container 20 is shown which is particularly suitable for the bulk packing of a variety of products (e.g., ice cream). The container 20, when loaded with ice cream, is normally shipped in a refrigerated condition directly to the customer, such as a restaurateur, where small individual servings of the product are dispensed directly from the container through its open top.

Heretofore, the bulk packing of such a product usually involved the use of a cylindrical container formed of a sleeve of metal or convoluted fiberboard having separate top and bottom closures. With such a container it was necessary that the entire cylindrical container, or at least the sleeve therefor, be formed at the time of its manufacture with the result that storing and/or shipping of the empty, as well as loaded, cylindrical containers or sleeves required an inordinate amount of space. Furthermore, the cylindrical containers were costly to manufacture and difficulty was oftentimes encountered in initially removing the top closure once the contents of the container had solidified to form ice cream. To remove the top closure frequently required prying of the closure with a suitable tool to break the bond which develops between the underside of the closure and the upper end portion of the frozen contents with the result that the container became mutilated or defaced. The improved container 20, as will hereinafter be described, readily avoids the aforenoted shortcomings which beset the prior cylindrical containers.

Container 20 is formed from a single blank 21 of foldable sheet material, such as double-faced corrugated fiberboard. As seen in FIG. 1, blank 21 comprises four side panels 22, 23, 24 and 25 arranged in side by side relation. THe adjacent side panels are connected by a first set of foldines 26 disposed in spaced parallel relation. Connected by a foldline 27 to the outer edge of the endmost side panel 25 is a glue flap 28. Foldlines 26 and 27 are in spaced parallel relation.

Because the illustrated container 20 is of rectangular configuration, alternate panels 22 and 24 are wider than alternate panels 23 and 25.

Connected by foldlines 30 to the lower edges of alternate panels 23 and 25 is a first pair of bottom closure flaps 31, 32. Each flap 31, 32 is of like configuration and includes a locking tab 31*a*, 32*a* which projects from the edge 31*b*, 32*b* thereof which is remote from foldline 30. Each tab is positioned off-center on the edge 31*b*, 32*b* and is provided with a small lateral protuberance 31*c*, 32*c*, the purpose of which will be described more fully hereinafter.

Connected by foldlines 33 to the lower edges of alternate panels 22, 24 is a second pair of bottom closure flaps 34, 35. Flap 35 is the first folded flap when the bottom is formed and has a configuration which approximates the area delimited by the lower edges of the side panels when the latter are squared up, see FIG. 7.

Figure 7:
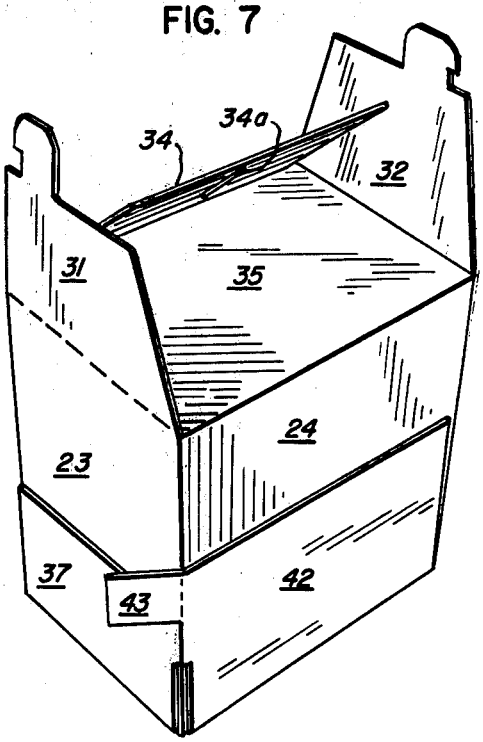
FIG. 7 is similar to FIG. 6 but showing the partially set up container in an inverted position and the bottom closure flaps thereof being moved into overlapping bottom-forming positions.
Figure 8:
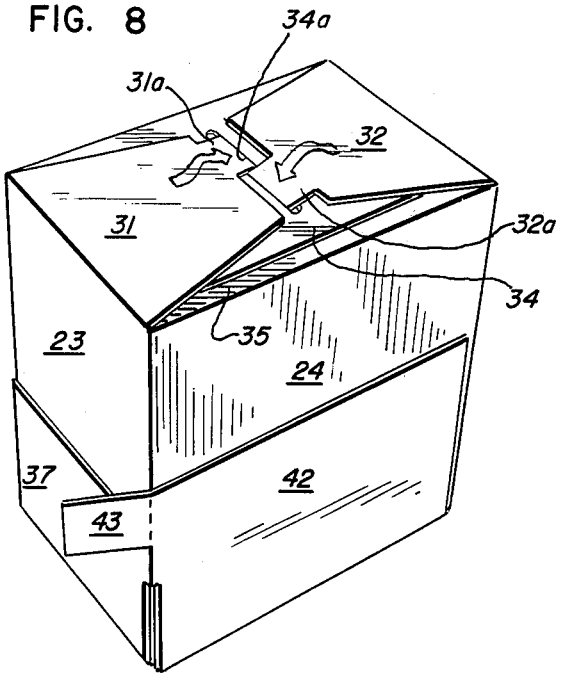
FIG. 8 is similar to FIG. 7 but showing the locking tabs of one pair of bottom closing flaps accommodated in interlocking relation within a slot formed in one of the other pair of bottom closure flaps.

Flap 34 is adapted to overlie first folded flap 35 and is provided with a transversely extending elongated slot 34*a* which is centrally disposed. The longitudinal axis of the slot is substantially perpendicular to foldline 33. The size of slot 34*a* is such that it will interlockingly accommodate locking tabs 31*a*, 32*a* when they are inserted therethrough during set up of the container, see FIG. 8. It will be noted in FIG. 8 that when the tabs are inserted through the slot, they are extending in opposite directions and the tab protuberances 31*c*, 32*c* will engage and interlock with the ends of the slot and prevent accidental withdrawal of the tabs from the slot. Flap 34 closely approximates the aforenoted area delimited by the lower edges of the side panels. As seen in FIGS. 7 and 8 the first pair of flaps 31, 32 will overlie flap 34 and interlock with the slot 34*a* thereof and thus, securely retain flaps 31, 32, 34 and 35 in proper folded bottom-forming relation, see FIG. 8.

Connected by foldlines 36 to the upper edges of side panels 23, 25 is a first pair of top closure flaps 37, 38. Connected by foldlines 40 to the upper edges of the remaining side panels 22, 24 is a second pair of top closure flaps 41, 42. Flaps 37, 38 are of substantially like configuration and are adapted to overlie flap 42 when the top closure flaps are folded relative to one another into a top-closing relation. Flap 42 has a shape which is substantially the same as that of the area delimited by the upper edges of the side panels when the side panels are squared up relative to one another. Extending laterally from one peripheral segment of the flap 42 and disposed a substantial distance from foldline 40 is a foldable finger pull tab 43. Tab 43 is connected to flap 42 by a short foldline 44. A slit X separates the tab from the outer edge of flap 37, see FIG. 1. The purpose of the tab 43 will become apparent from the discussion hereinafter.

Aligned with foldline 44 is a tear score 45 which connects adjoining peripheral segments of flaps 37, 42. Tear score 45 is relatively short and terminates at one end at an elongated slot 46, which, in turn, is aligned with the foldline 26 interconnecting side panels 23, 24. In a similar manner a peripheral segment of flap 38 is connected by a tear score 47 to a foldable extension 28*a* of glue flap 28, see FIG. 1. One end of tear score 47 terminates at and is aligned with an elongated slot 48. The slot 48 is aligned with the foldline 27 interconnecting glue flap 28 and side panel 25.

Figure 10:
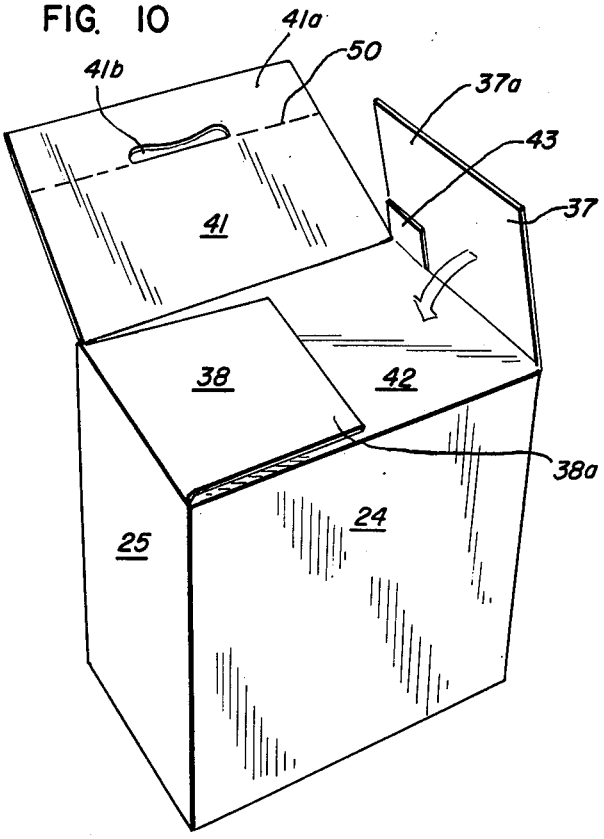
FIG. 10 is similar to FIG. 9 but showing the first and second folded top closure flaps in top closing positions and the remaining flaps being moved to similar positions.

Flap 41 has a peripheral configuration similar to that of flap 42, except for the pull tab 43. Flap 41 is the last top closure flap to be folded when the flaps 37, 38, 41 and 42 are folded relative to one another into top closing relation, see FIGS. 10–11.

It will be noted in FIG. 1 that flap 41 has an outer edge portion 41*a* which is connected by an elongated foldline 50 to the remainder of the flap 41. Portion 41*a* has formed therein an elongated handhole 41*b*. Thus, when the top closure flaps are in top-closing relation, the portion 41*a* may be folded about foldline 50 so as to assume an upright position (shown in phantom lines in FIG. 11) and thereby provide a convenient handle for manually carrying the loaded shipping container.

Figure 9:
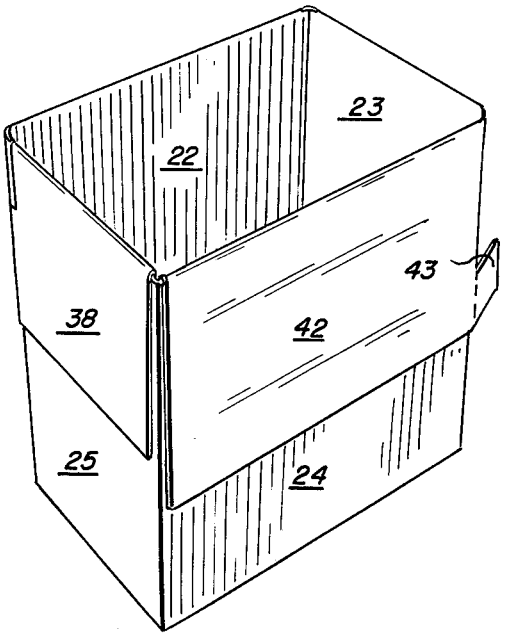
FIG. 9 is similar to FIG. 8 but showing the container inverted and ready for loading.

In setting up the blank 21 to form the container ready for loading, as seen in FIG. 9, the blank 21 is initially folded so as to assume a first condition as shown in FIGS. 2 and 3. To attain the first condition from the blank of FIG. 1, the blank should first be turned over and side panel 22 and associated closure flaps 34, 41 folded as a unit about foldline 26 so as to overlie side panels 23, 24 and their associated closure flaps 31, 37 and 35, 42. Side panel 25 and associate closure flaps 32, 38 and glue flap 28 and the extension 28*a* thereof are folded as a unit about the foldline 26 disposed between side panels 24, 25, whereupon the glue flap 28 and its extension 28*a* are adhesively or otherwise secured to the exterior of the adjacent side portions of panel 22 and top closure flap 41, see FIG. 2. The blank 21, when in such a condition, see FIGS. 2 and 3, may be readily stored and/or shipped to the customer while occupying only a minimum amount of space.

Figure 4:
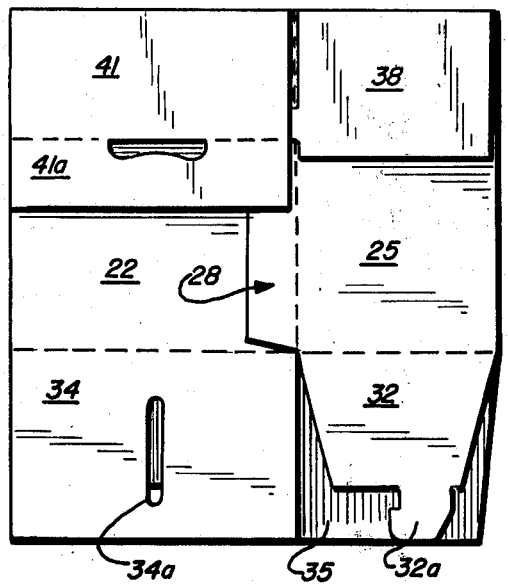
FIGS. 4 and 5 are similar to FIGS. 2 and 3, respectively, subsequent to the next step of setting up having been performed.
Figure 5:
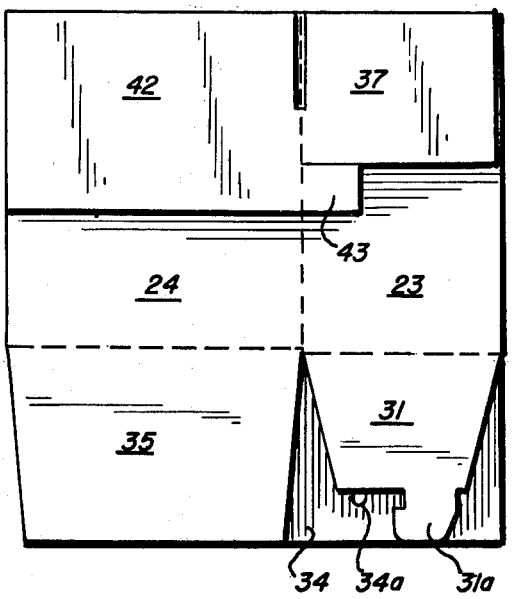

The next step in setting up the container for loading is shown in FIGS. 4 and 5 wherein top closure flaps 38, 41 are folded as a unit so as to overlie the exterior of respective side panels 25 and 22, see FIG. 4. In a similar manner top closure flaps 37, 42 are folded as a unit so as to overlie the exterior of side panels 23, 24, see FIG. 5. Because flaps 37, 42 are interconnected by tear score 45, and flap 41, through glue glap extention 28*a* is connected to flap 38 by tear score 47, the folding of the top closure flaps into overlying relation with the exterior of the side panels is greatly facilitated.

Figure 6:
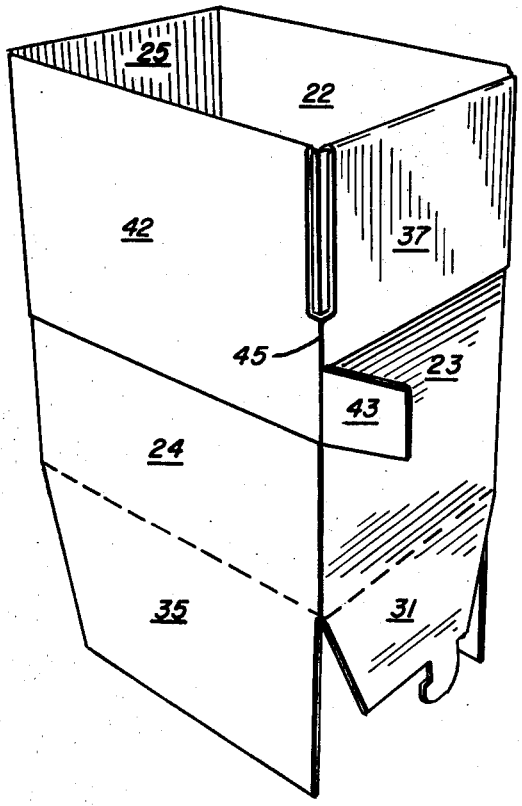
FIG. 6 is a perspective view of the next successive step of setting up the blank of FIG. 1.

FIGS. 6 and 8 illustrate the third and fourth steps in setting up the container; namely, squaring up the side panels, as seen in FIG. 6, and then inverting the squared up side panels so that the bottom-closure flaps face upwardly, as seen in FIG. 7 whereupon the closure flaps are folded relative to one another so as to form a closed bottom, FIG. 8. In folding the bottom closure flaps, flap 35 is first folded inwardly so as to present a smooth surface to the product to be subsequently loaded into the container when it is disposed as seen in FIG. 9. Flap 34 is then folded so as to overlie flap 35. When flap 34 is in proper folded portion, the slot 34*a* will be centrally disposed relative to side panels 23, 25. Flaps 31, 32 are then folded inwardly towards one another and the respective locking tabs 31*a*, 32*a* are inserted in opposite directions through the slot 34*a* until the protuberances 31*c*, 32*c* are concealed beneath the flap 34 and interlockingly engage the adjacent end limits of the slot 34*a* thereby preventing accidental withdrawal or unlocking of the tabs from the slot.

Because of the squaring up of the side panels, the previously folded back top closure flaps will remain snugly in overlying relation against the exterior of the side panels because each pair of adjacent top closure flaps are interconnected by a tear score 45 or 47.

Once the container shown in FIG. 9 has been filled with the product (e.g. ice cream in a fluid state), the tear scores are severed either manually or with an appropriate tool, so that the top closure flaps can be folded relative to one another into a top-closing relation. To attain the top-closing relation, closure flap 42 is first folded so as to overlie the top of the product, see FIG. 10, and then flaps 37, 38 are folded inwardly so as to overlie flap 42. It should be noted in FIG. 10, that as flap 37 is folded inwardly finger pull tab 43 will be folded thereby so as to overlie the exterior of flap 42. If desired, flaps 37, 38 may be secured by spots of adhesive to the exterior surface of flap 42. Once flaps 37, 38 assume proper overlapping relation with flap 42, flap 41 is then folded so as to overlie flaps 37, 38. Except for portion 41*a*, flap 41 is adhesively secured to the exterior surfaces of flaps 37, 38. By not securing flap portion 41*a* to the exterior surfaces of flaps 37, 38, the portion 41*a* can be manually moved to an upright position as seen in phantom lines in FIG. 11 so as to provide a convenient handle for carrying the loaded container.

When the loaded container, as shown in FIG. 11, is to be initially opened for dispensing the product in small individual servings with a spoon, scoop or the like, closure flaps 41, 37 and 38 are first unfolded so as to expose pull tab 43. Once flap 37 has been unfolded, tab 43 will automatically assume a projecting position relative to the remainder of flap 42. Tab 43 facilitates manual pulling of the flap 42 to an unfolded position so as to expose the top of the product. Without pull tab 43 difficulty might otherwise be encountered in breaking the frozen bond which would normally exist between the product and the concealed surface of flap 42. Once the top closure flaps have been unfolded, they may be severed from associated side panels, if desired.

Because of the rectangular or square exterior configuration of the container 20, the latter when loaded, may be readily stored or shipped with like containers, so as to occupy a minimum space. Furthermore, prior to loading, the blank 21 may be stored by or shipped to the customer in either a completely unfolded state (FIG. 1) or in a collapsed state such as shown in FIGS. 2 or 4.

The shape and size of the container may vary from that shown and will depend to a substantial extent upon the type of product to be packaged therein. Thus, it will be noted that an improved container and blank therefor has been provided which is of simple, inexpensive, yet, sturdy construction, and may be readily set up or loaded either manually or by semi-automatic equipment.

We claim:

1. A blank of foldable sheet material for a shipping container, comprising at least four side panels arranged in side by side relation, first foldlines interconnecting adjacent panels; a first set of end closure flaps connected by second foldlines to corresponding peripheral segments of said side panels and including a first pair of alternate closure flaps, each being provided with a complemental locking tab projecting outwardly from an outer peripheral edge of the flap and disposed off-center with respect to said outer peripheral edge, and a second pair of alternate end closure flaps, one flap of said second pair being provided with an elongated slot disposed substantially transversely of said second foldlines and being substantially aligned with the center of the outer peripheral edges of the first pair of alternate closure flaps and being sized to interlockingly accommodate said complemental locking tabs, when the blank is set up to form the shipping container, the second flap of said second pair of end closure flaps being sized to conform substantially to the area delimited by the side panels when the blank is set up to form the container and being adapted to be disposed inwardly of the said one flap; and a second set of closure flaps connected by third foldlines to second corresponding peripheral segments of said side panels.

2. The blank of claim 1 wherein each locking tab is provided with a laterally extending projection which is adapted to interlock with a peripheral end segment of the slot when said tabs are inserted into the slot during set up of the blank to form a shipping container.

3. A blank of foldable sheet material for a shipping container, comprising at least four side panels arranged in side by side relation, first foldlines interconnecting adjacent panels; bottom closure flaps connected by second foldlines to first corresponding peripheral segments of said side panels; and top closure flaps connected by third foldlines to second corresponding peripheral segments of said side panels, a first top closure flap being adapted to be first folded to a top closing position, when the blank is set up to form a shipping container, said first flap having a shape corresponding substantially to the area delimited by the side panels of the set up container and a finger pull tab connected to the periphery of said first flap by a foldline substantially aligned with a first foldline, said pull tab being spaced a substantial distance from the third foldline connecting said first top closure flap to a side panel, said pull tab being sandwiched between said first top closure flap and another of said top closure flaps when said blank is set up to form the container.

4. The blank of claim 3 wherein said top closure flap includes a second flap which is adapted to overlie the first top closure flap when the blank is set up to form the shipping container, said second flap being provided with a handle portion spaced a substantial distance from the third foldline connecting the second flap to a side panel, said first and second top closure flaps being foldably connected to alternate side panels.

5. A blank of foldable sheet material for a shipping container, comprising at least four side panels arranged in side by side relation, first foldlines interconnecting adjacent panels; bottom closure flaps connected by second foldlines to first corresponding peripheral segments of said side panels, said bottom closure flaps including a first pair of alternate bottom closure flaps wherein each of the latter is provided with a complemental locking tab projecting outwardly from an outer peripheral edge of the flap, and a second pair of alternate bottom closure flaps, one of said second pair of bottom closure flaps being provided with an elongated slot disposed substantially transversely of said second foldlines and being sized to interlockingly accommodate the complemental locking tabs, when said blank is set up to form the shipping container; and top closure flaps connected by third foldlines to second corresponding peripheral segments of said side panels, a first of said top closure flaps being adapted to be first folded to a top closing position, when the blank is set up to form a shipping container, said first top closure flap having a shape corresponding substantially to the area delimited by the side panels of the set up container, and a finger pull tab foldably connected to the periphery of said first top closure flap and spaced a substantial distance from the third foldline connecting the latter flap to a side panel.

6. The blank of claim 5 including a glue flap connected by a fourth foldline to the outermost side panel of the second pair of alternate side panels, the first and fourth foldines being disposed in spaced substantially parallel relation, said glue flap being provided with a foldable end portion having a peripheral segment thereof connected by a second tear score to the adjacent peripheral segment of the other of the third top closure flaps.

7. A shipping container formed from a blank of foldable sheet material comprising four side panels foldably interconnected and having alternate side panels arranged in spaced opposed relation; a first pair of alternate bottom closure flaps, each having a complemental locking tab projecting from the outer peripheral edge of the flap towards the other flap, each locking tab being disposed off-center with respect to the flap outer peripheral edge, said first pair of alternate bottom closure flaps being disposed outwardly of a second pair of alternate bottom closure flaps, said complemental locking tabs being inserted in opposite directions in an elongated slot formed in one of the second pair of alternate bottom closure flaps, said inserted tabs interlockingly engaging end portions of said slot, the other of said second pair of alternate bottom closure flaps being sized to conform substantially to the area delimited by the side panels and being disposed inwardly of the slotted flap; and means for closing the top of container.

8. A shipping container formed from a blank of foldable sheet material comprising four side panels foldably interconnected and having alternate side panels arranged in spaced opposed relation; a first pair of alternate bottom closure flaps connected to the lower edges of first alternate side panels, each of the first pair of alternate bottom closure flaps being provided with a complemental locking tab; a second pair of alternate bottom closure flaps in overlapping relation and being subtended by said first pair of alternate bottom closure flaps, one flap of the second pair being provided with an elongated slot in which the locking tabs are interlockingly accommodated; a first pair of alternate top closure flaps connected to the upper edges of alternate side panels, the first folded of said first pair of alternate top closure flaps having a shape corresponding substantially to the area delimited by the side panels and being provided with a finger pull tab foldably connected to a peripheral segment of the first folded top closure flap and spaced a substantial distance from the side panel to which the said first folded flap is connected, a second flap of the first pair of top closure flaps overlying said first folded top closure flap and cooperating therewith to sandwich therebetween a second pair of alternate top closure flaps.

9. The shipping container of claim 8 wherein the second flap of the first pair of alternate top closure flaps is provided with a foldable outer handle portion being adapted to assume an upright position.

* * * * *

UNITED STATES PATENT AND TRADEMARK OFFICE

CERTIFICATE OF CORRECTION

PATENT NO. : 4,059,221

DATED : NOVEMBER 22, 1977

INVENTOR(S) : GREGORY J. OLSON and WAYNE A. CHAPMAN

It is certified that error appears in the above-identified patent and that said Letters Patent are hereby corrected as shown below:

Column 1, line 7 - "performed" should be --preformed--

Column 2, line 67 - "THe" should be --The--

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*